US006299533B1

(12) United States Patent
Parra et al.

(10) Patent No.: US 6,299,533 B1
(45) Date of Patent: Oct. 9, 2001

(54) UNIVERSAL PROGRESSIVE GAME FOR LIVE CASINO GAMES

(76) Inventors: Anthony C. Parra; Debra L. Parra, both of 515 Harlowe La., Naperville, IL (US) 60565

( * ) Notice: Subject to any disclaimer, the term of this patent is extended or adjusted under 35 U.S.C. 154(b) by 0 days.

(21) Appl. No.: 09/243,353

(22) Filed: Feb. 1, 1999

Related U.S. Application Data

(63) Continuation-in-part of application No. 08/961,357, filed on Oct. 30, 1997, now Pat. No. 5,876,283.

(51) Int. Cl.[7] ..... A63F 3/06

(52) U.S. Cl. ..... 463/17; 463/42; 463/27; 273/309; 273/274

(58) Field of Search ..... 463/42, 26, 27, 463/28, 12, 13, 17, 20; 273/274, 143 R, 309, 292

(56) References Cited

U.S. PATENT DOCUMENTS

| | | | | |
|---|---|---|---|---|
| 4,836,553 | | 6/1989 | Suttle et al. | 273/292 |
| 4,861,041 | | 8/1989 | Jones et al. | 273/292 |
| 5,248,142 | * | 9/1993 | Breeding | 273/274 |
| 5,564,700 | * | 10/1996 | Celona | 463/27 |
| 5,573,248 | | 11/1996 | Parra et al. | 273/274 |
| 5,626,341 | * | 5/1997 | Jones et al. | 273/292 |
| 5,797,794 | * | 8/1998 | Angell | 463/18 |

* cited by examiner

*Primary Examiner*—Benjamin H. Layno
(74) *Attorney, Agent, or Firm*—Robert L. Marsh

(57) ABSTRACT

To provide a universal progressive game, incorporating a number of types of games at a casino, all the gaming tables which participate in the progressive game have the same number of play stations with each play station usable by one player. Each play station has an identifying number or symbol. For each type of game being played on the tables there is a winning combination entitling a player to win in the progressive jack pot where the winning combination includes the identification number, or symbol which identifies the player's play station with respect to the table. The invention includes a proxy progressive game in which a player can wager that the progressive game will be won by a player at a play station bearing identification number which is different from his own. The proxy progressive game includes a keyboard or the like whereby a player can select an identification number for a station other than his own, and in the event a wining combination occurs at that play station bearing an identification other than his own, he will participate in a second reward.

16 Claims, 6 Drawing Sheets

UNIVERSAL PROGRESSIVE GAME FOR LIVE CASINO GAMES

The present application is a continuation in part of the applicant's prior application filed the Oct. 30, 1997 and assigned Ser. No. 08/961,357 now U.S. Pat. No. 5,876,283. The present invention relates to progressive games, and in particular to a progressive game which can be employed with any of a number of games played in a casino.

BACKGROUND OF THE INVENTION

A gambling establishment has a number of games which appeal to a person's temptation to take a risk, with the hope and expectation that the risk taken at the right time and under the right circumstances will result in a return which far exceeds the investment. A typical casino provides many games to a prospective customer including black jack, poker, baccarat, roulette, craps and slots.

Recently, progressive games have been introduced into casino play. The progressive game includes a jackpot and participants who wish to wager on the progressive game contribute a fixed wagering amount by token or cash into a jackpot, and if the participant does not win, a portion of his contribution is added to the jackpot. Accordingly the jackpot becomes progressively larger with each unsuccessful bet until a winner is determined.

Jones, U.S. Pat. No. 4,861,041 taught a method whereby a progressive game could be offered as a side bet to a game of poker. In our prior patent U.S. Pat. No. 5,573,248 we taught a method whereby a progressive game could be offered as a side bet to a game of craps. In our prior application Ser. No. 08/961,357 we taught a method whereby a progressive game could be offered as a side bet to a game of baccarat.

Casinos have found that progressive games facilitate in the attraction of players into games, the retention of players who have already engaged in a game, and on the whole, increase table or slot profitability. Casinos are, therefore, seeking to incorporate a progressive game with each type of game played within the casino. It would also be desirable to provide a progressive game which would interact with a number of different games in the casino. For example, it would be desirable to have a universal progressive whereby a player at a black jack table could participate and win a portion of the progressive jack pot in the event of the occurrence of a given winning combination in a poker hand at a distant table in the casino.

SUMMARY OF THE INVENTION

Briefly, the present invention is embodied in a universal progressive game wherein a player is provided the opportunity to wager an additional bet to win an additional reward where there are a plurality of gaming tables. In accordance with the invention, each gaming table has a playing surface suitable for use by the game for which the playing surface is intended, and all the game tables participating in the universal progressive game have the same number of play stations, each of which is suitable for use by one player. Each play station also has an identification number or symbol and an additional wagering receptor for receiving a suitable wagering token, such as a coin, for participating in the progressive game.

In accordance with the present invention, each casino game has a set of winning conditions under which a player positioned at a given play station is entitled to win a portion of the progressive game jackpot. A player at play station number 4 of a black jack table, for example, would win a progressive black jack game if he deposited money in the receptor of his station before the commencement of a hand and he was dealt a pair of fours, and the dealer was likewise dealt a pair of fours on both of their first two cards. The set of conditions under which a player at a numbered play station of a black jack table, therefore, has a winning combination if the cards dealt to both the dealer and the player are identical to the number of his play station.

For roulette, a player at a play station bearing a given number who deposits a token in the receptor to participate in the progressive game would win if the player bets on a number associated with his play station, the ball comes to rest in the hole for that number, and the rotating portion of the wheel stops with the ball against a section of the surrounding race which bears the same number as the player's play position.

A player at a play station of a poker table who has deposited money in the receptor for the progressive game has a winning combination when the dealer has a hand of four of a kind and the four cards bear the number of his play position.

A player at a slot machine would win if he deposits the maximum number of coins in the machine, including one for the progressive game, and the top award combination occurs on the reels after the handle has been pulled, and the top award includes a number corresponding to the number of the player's play station.

The invention includes a record keeping means such as a computer which will record the occurrence of the selected set of conditions for winning a portion of the jackpot by a progressive player.

In accordance with the invention, when the selected set of conditions for winning a reward occurs for a first player at a first play station having a given first number, a portion of the jackpot is paid to a second player positioned at a second play station for which a token has been deposited into the receptor for the progressive game and the number for the play station of the second player is identical to that of the first play station.

In our patent U.S. Pat. No. 5,573,248 we disclosed a craps game and table having six play stations for receiving six players at the game and a progressive game employing a first pair of dice for playing a conventional craps game and a third die for playing the progressive part of the game. In the parent to the present application we also disclosed a baccarat game in which a player at a play station with a given number will win if the first two cards in the player's hand and the first two cards in the banker's hand all bear numbers identical to the number of the play station.

In accordance with the present invention, a universal progressive game is provided in which a winner will participate in the jackpot upon the occurrence of a winning combination in any of a number of types of casino games. To integrate a number of types of games into a universal progressive game, the number of play stations that on each game table participating in the universal progressive game must be the same for all tables. In the preferred embodiment the play tables of all games will have six play stations to accommodate six players. A gaming table for craps was disclosed in our prior patent U.S. Pat. No. 5,573,248 which would accommodate six players. The table disclosed by Jones U.S. Pat. No. 4,861,041 can be adapted to accept six players and in like manner all of the game tables of each type of game in the casino participating in the progressive game would have six play stations, each of which is numbered one through six. A computer records the occurrence of a winning combination at any of the tables participating in the progressive game, and when a first player at a first play station receives a winning combination, a player at a second table at a play station having a number identical to that of the first play station will share in the universal progressive jackpot if he has deposited a token in the appropriate receptor.

The invention further envisions a proxy progressive jackpot wherein a player may wager on the possibility that the progressive jackpot award will be won at a play station identified by a number different from the player's own play station number. The proxy progressive game may be played by either requiring the player to deposit six tokens instead of one, thereby depositing a token for each of the six play stations, or by providing a selection means, such as a key pad, whereby the progressive game player may deposit less than six tokens and the key pad is punched to enter play station numbers for which he wishes to participate in the progressive game.

BRIEF DESCRIPTION OF THE DRAWINGS

A better understanding of the present invention will be obtained after a reading of the following detailed description taken in conjunction with the drawings wherein.

DETAILED DESCRIPTION OF THE PREFERRED EMBODIMENT

Figure 1:
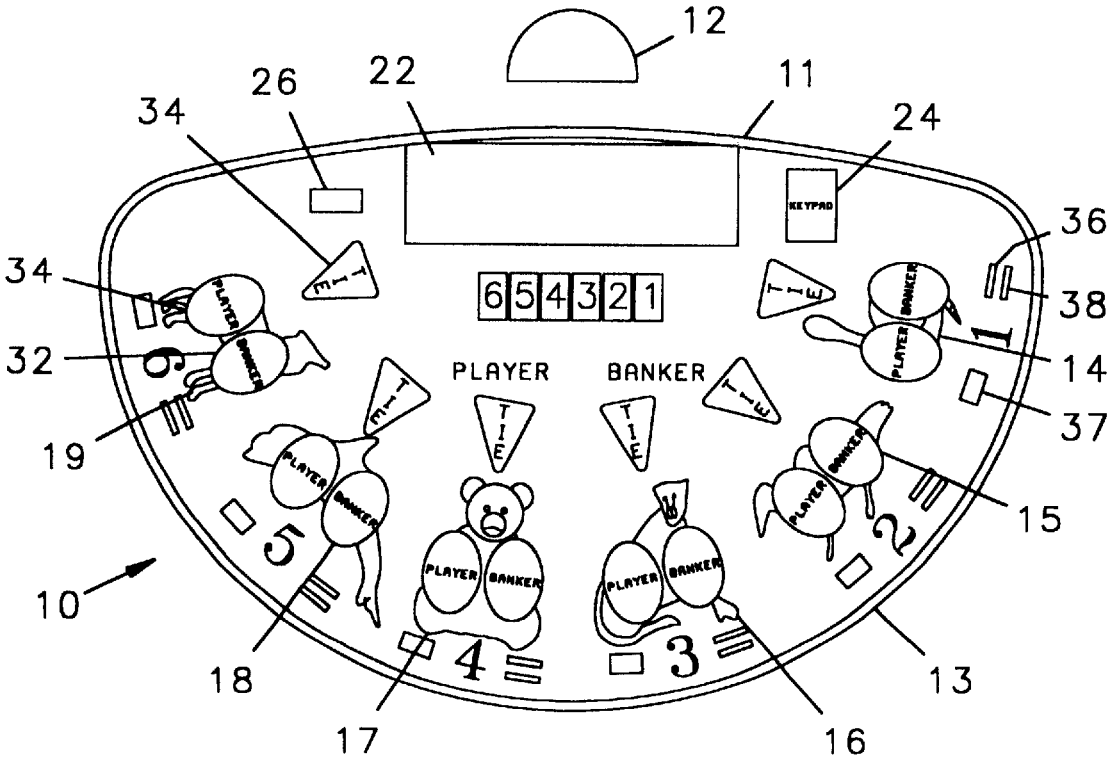
FIG. 1 is a top elevational view of a play surface for use with a game of baccarat.

Referring to FIG. 1, a baccarat table 10 has a banker's edge 11 allowing a dealer seated in a chair 12 to face a plurality of players positioned at play stations along the arcuate outer edge 13. Six play stations 14, 15, 16, 17, 18, 19 are depicted and each of the play stations bears a identification number such that the play stations 14, 15, 16, 17, 18, 19 are numbered one through six respectively. The table includes an area 22 where the dealer can retain chips, a key pad 24 to enable the dealer to input information relating to the progressive portion of the game, and to cut off late bets for the progressive game, and a drop slot 26 into which cash exchanged by the gambling establishment for chips may be placed.

Although the pay stations 14–19 are described as being numbered and are depicted as bearing numerals 1 through 6, it should be appreciated that the play stations could be identified by lettering them A, B, C, D, E and F. Other symbols may also be used to identify the various play station positions, and for the purposes of the discussion the terms "numbered," "identification numbers" or "numbering" shall refer to all such methods of identification.

Figure 9:
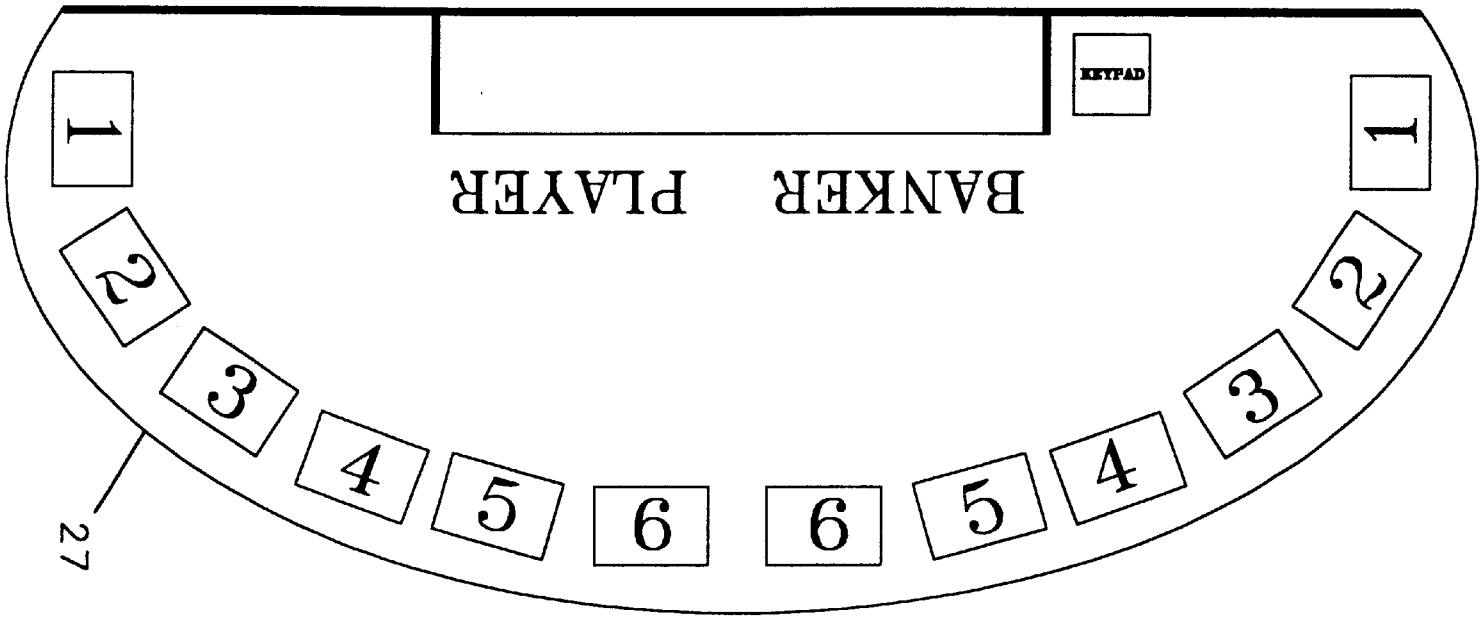
FIG. 9 is a schematic top view of an alternate embodiment of a baccarat table.

Baccarat is generally played at a table which can accommodate more than six players, and a larger baccarat table such as shown in FIG. 9 can be employed with the present invention where numbers of play stations at a larger table are a multiple of the number of play stations at a smaller table, the table 27 is depicted as having twelve play stations divided into two groups with each group being numbered one though six. It should also be appreciated that a different numbering system may be employed at the larger tables.

The rules of the game of baccarat are well known and are not set forth herein, however, each of the six play stations 14–19 has markings suitable for use in the game of baccarat including a player bet area 30, a banker bet area 32, and tie bet area 34. The bet areas 30, 32, 34 are intended to receive chips of a player at the play station who desires to place a bet on the success of the player or the banker, or for a tie, on each hand of baccarat. Each play station further has a first slot 36 for receiving a token whereby the player would participate in a progressive game, and a key pad 37 and a second slot 38 for receiving a token for participating in a proxy progressive game as further described below.

Figure 8:
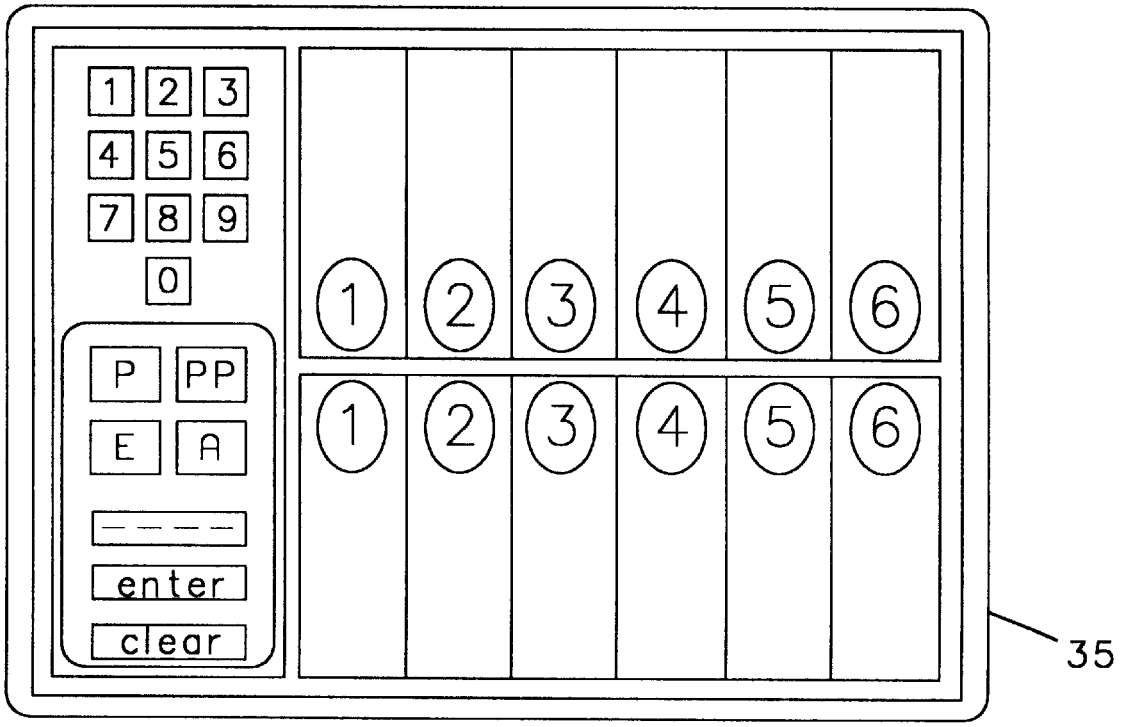
FIG. 8 is a top elevational view of a keypad for use by a dealer for a progressive or proxy progressive game.

While a key pad 37 is depicted as being positioned near each play station, the progressive game may alternately provide a key pad near the dealer such as key pad 35 showing in FIG. 8. The key pad 35 can be adapted to allow the dealer to enter all progressive and proxy progressive bets.

Figure 2:
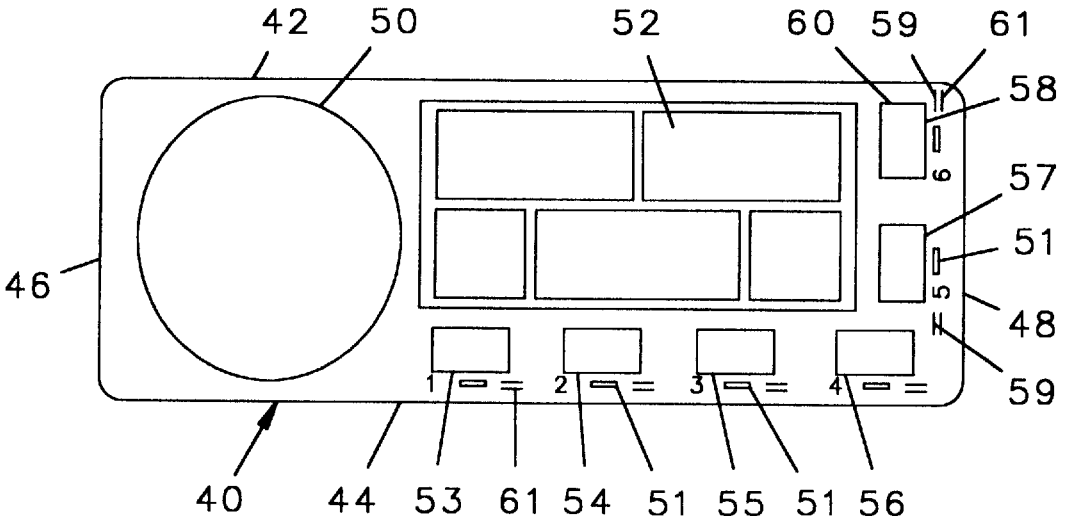
FIG. 2 is a top elevational view of play surface for use with a game of roulette.

Referring to FIG. 2, a roulette table 40 is generally rectangular in shape with a first long side 42 for use by a dealer, an opposing second long side 44 and first and second short sides 46, 48 respectively. A roulette wheel 50 is positioned near the first short side 46 and a betting pattern 52 is positioned adjacent to the roulette wheel 50 and adjacent the first long side 40 such that a dealer can operate the wheel 50 and supervise bets. Four play stations numbered 53, 54, 55, 56, extend along the second long side 44 and two play stations numbered 57, 58 extend along the second short side 48 as shown. The play stations 53–58 are numbered 1 through 6 respectively and each play station has a betting area 60 with markings thereon suitable for placing bets for the game of roulette. Each play station further has a first slot 59 for receiving a token whereby a player can participate in a progressive game, and a key pad 51 and a second slot 61 for a receiving a token whereby the player can participate in a proxy progressive game as further described below. As previously stated, the progressive and proxy progressive bets may alternately be entered from a key pad controlled by the dealer.

Figure 3:
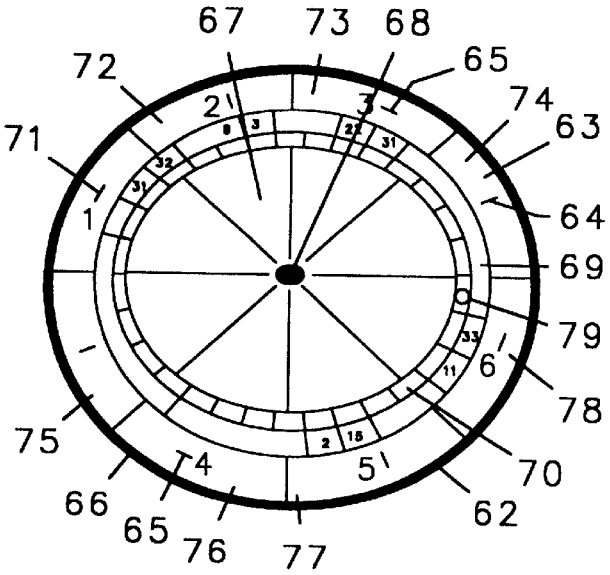
FIG. 3 is a roulette wheel for use in the table shown in FIG. 2.

Referring to FIG. 3, the wheel 62 used in conjunction with a progressive game has a stationary annular outer race 63 with ridges 64 and canoes 65 thereon, and an annular lip 66 surrounding the race 63. The rotating central portion 67 of the wheel 62 includes a capstan 68, and near the peripheral edge are the numbers 69. Inward of the numbers 69 is a separation ring 70 with a plurality of separator holes, one of each of the numbers 69. In accordance with the present invention, the annular outer race 63 is divided into eight sections, 71, 72, 73, 74, 75, 76, 77, 78 of which section s71, 72, 73 are identified with indicia numbers 1, 2, and 3 respective and sections 75, 76, 77 are identified with indicia numbers 4, 5 and 6 respectively as shown. Sections 74 and 78 are left unnumbered.

The rules for playing roulette, like the rules of all casino games, are well known and are not set forth at length herein except for the portions thereof which relate to the progressive game. In the course of the game, players bet on one or more of the numbers 69 after which the central portion 67 is spun and the ball 79 is rolled around the race 63 and against the annular lip 66. Eventually the ball 79 will come to stop in a hole identified by one of the numbers 69. When the central portion 67 stops rotating, the numbered hole in which the ball has landed will be against one of the eight sections 71–78.

Figure 4:
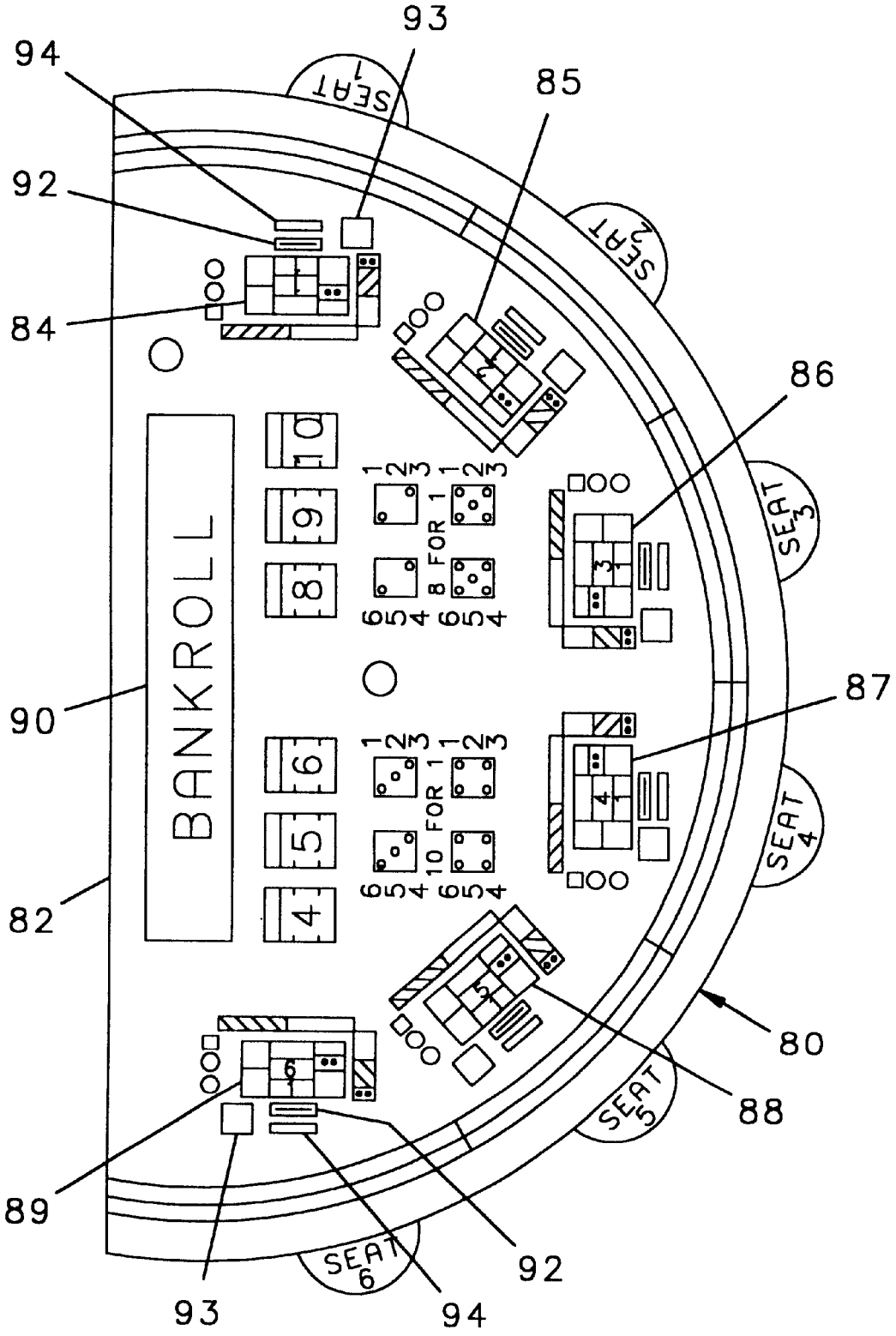
FIG. 4 is a top elevational view of play surface for use with a game of craps.

Referring to FIG. 4, crap table 80 has a substantially linear dealer's side 82 and an arcuate outer edge 83 with six play stations 84, 85, 86, 87, 88, 89, each of which is numbered 1 through 6 respectively as shown. The use of the table 80 and the rules of the game of craps are set forth in detail in our above mentioned prior patent U.S. Pat. No. 5,573,248 and are incorporated herein by reference. For the purposes of the present invention, however, the table 80 includes a bank roll 90 for use by a dealer positioned along the linear side 82 and each of the play stations 84–89 includes a first slot 92 for receiving a token by which a player could participate in a progressive game and a key pad 93 and a second slot 94 by which a player could participate in a proxy progressive game.

Figure 5:
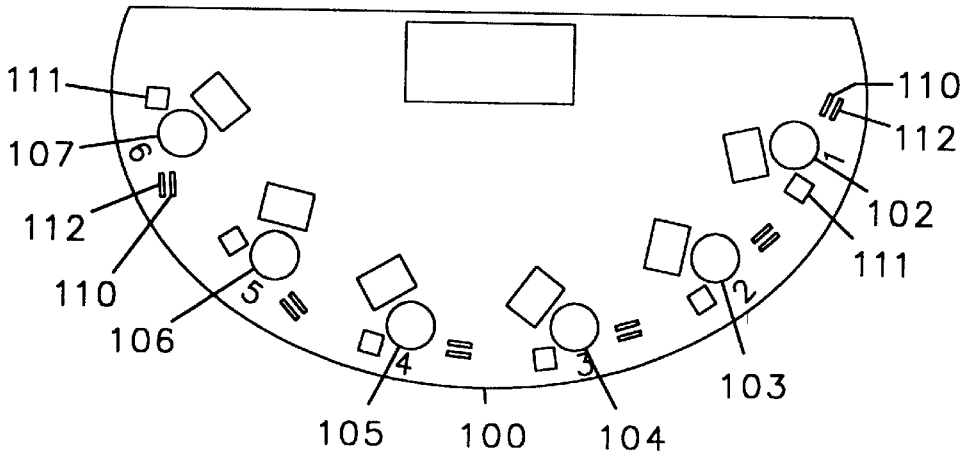
FIG. 5 is a top elevational view of a play surface for use with a game of poker or black jack.

Referring to FIG. 5, a table 76 suitable for use for a game of poker or a game of black jack in a casino is depicted. The table 96 has a generally linear banker's side 98, and an arcuate outer edge 100 along which are six play stations 102, 103, 104, 105, 106, 107 numbered 1 through 6 respectively. Like the play stations of the preceding tables, the play stations of the poker and black jack tables has markings suitable for use by a player of the game. Each play station 102–107 also has a first slot 110 for receiving a token by which the player could participate in the progressive game, and a key pad 111 and a second slot 112 by which the player could participate in a proxy progressive game. Alternately the table may have a single key pad usably by the dealer.

In accordance with the present invention, each casino game has a preselected set of winning conditions for participating in the jackpot of a progressive game. In the preferred embodiment, the winning combination for baccarat would occur when the first two cards dealt to a player's hand and the first two cards dealt to a dealer's hand are all identical and are equal to the numerical identification of the play station at which the player is seated. For example, a player at station four has a winning combination when the player's hand and the banker's hand both have a pair of fours. Similarly, a player at play station six has a winning combination when the player's hand and the banker's hand both have a pair of sixes.

Each game participating in the universal progressive game has a winning combination. For roulette, the preferred embodiment of the winning combination requires that a player first bet on a number associated with his play station. For example, the numbers 14, 24, and 34 are the numbers associated with play station four and the numbers 15, 25, and 35 are the numbers associated with play station five. The winning combination occurs when the ball lands in a number associated with the player's play station and the rotating portion of the wheel 69 comes to rest with the ball against the section 71–78 bearing the same number as that of the player's play position.

Figure 6:
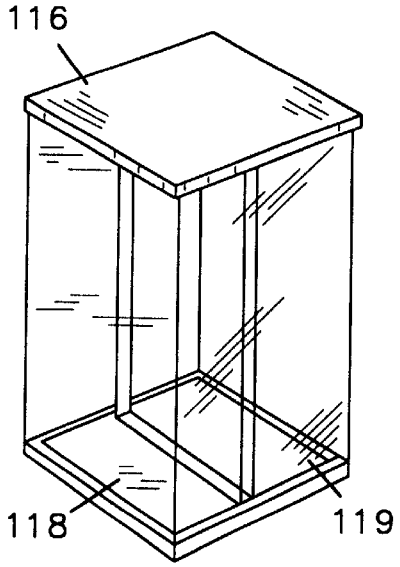
FIG. 6 is a shake container to be used with the crap table shown in FIG. 4.

In our prior patent U.S. Pat. No. 5,573,248 we disclosed how a progressive game can be linked to a crap table as shown in FIG. 4 where the dice are enclosed in a shake container 116 as shown in FIG. 6. The container 116 is made of a transparent material such as acrylic and has a first chamber 118 for retaining a first pair of dice for use in the game of craps, and a second chamber 119 which retains a third die employed in the progressive game. A player at a play station bearing one of the numbers one through six has a winning combination when the shake container 116 is turned and causes the dice to tumble and come to rest with the numbers showing "up" on all three of the dice being identical and equal to the number assigned to his play station.

Figure 7:
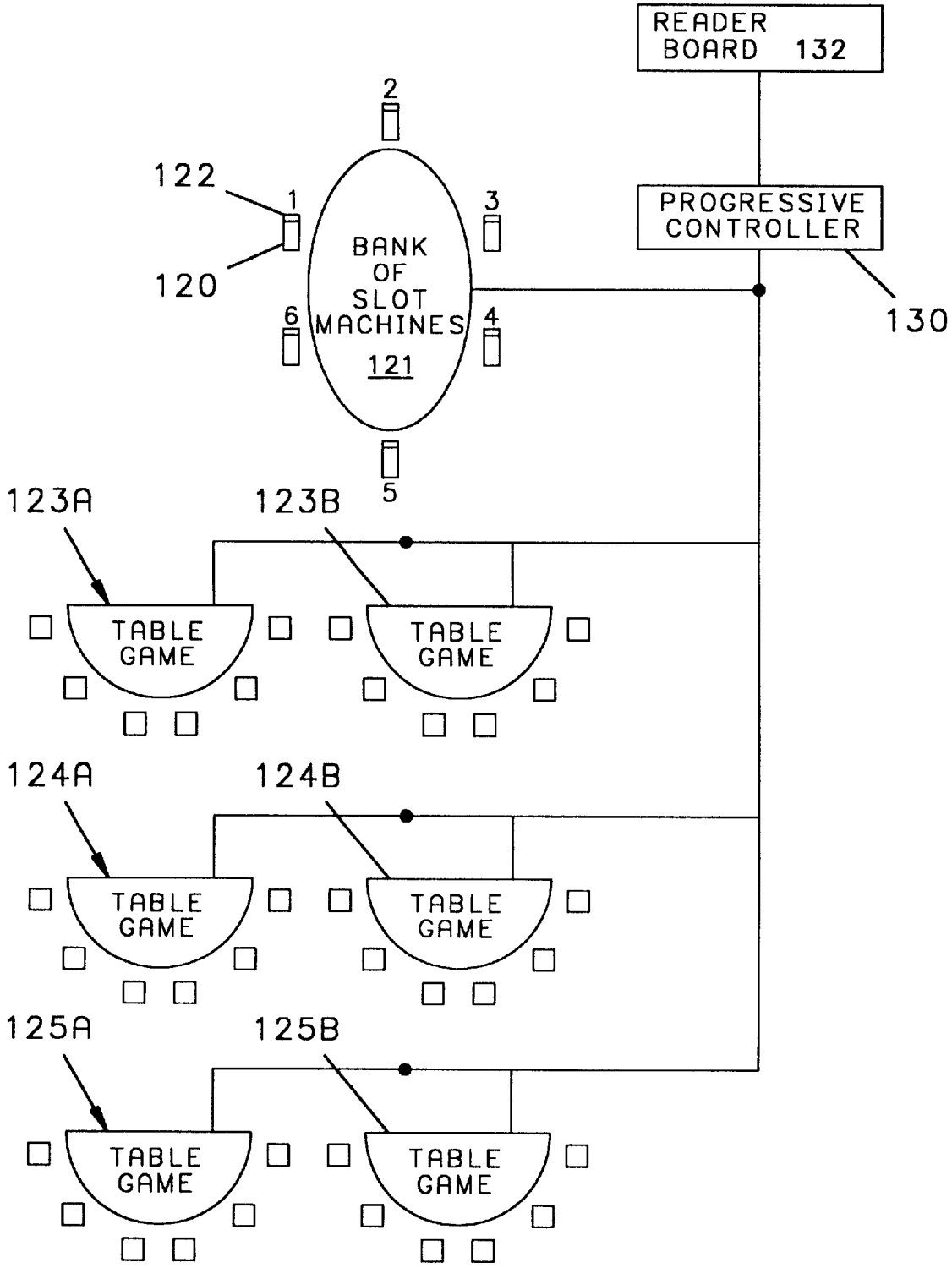
FIG. 7 is a schematic view of a progressive game which is played from any of a number of types of games.

Referring to FIG. 7, the winning combination for a player before a numbered slot machine 120 in a bank 121 occurs when the player has deposited the maximum number of coins into the machine 120, including a coin into a progressive game slot 122 and, after pulling the handle, the reels display a combination for the top award available on the machine.

For poker, the winning combination occurs when a dealer's completed hand has four of a kind and the numbers on the four cards are equal to the identification number for the play station at which a player is positioned.

For the game of blackjack, the winning combination occurs when the player's first two "up" cards are a pair and the dealer's first two cards (including the dealer's "up" cards and the dealer's "down" cards) are a pair and both are showing the same number as the player's play station.

Experienced poker and blackjack players who are capable of remembering the cards that have previously been played can count the high cards and determine changes in the odds. Players who count cards find it desirable to be in the last play position, that is the sixth person to be dealt cards, which is the player to the dealer's right. It is desirable therefore for the dealer at the table to deal each hand starting with a different player by utilizing a marker as shown in our first patent U.S. Pat. No. 5,573,248. However, the rotation of deal position will not change the play station number for a player.

To participate in a progressive game, a player will deposit a token, such as a coin, into the first slot 36, 59, 92, 110 at his play station before the game commences. Alternatively, the player may choose to wager on a proxy progressive game and deposit coins in the second slot 38, 61, 94, 112 for the proxy progressive game. The dealer will actuate a button, not shown, which may be below the play surface to lock players out of the progressive game who failed to make a timely wager.

Referring to FIG. 7, the universal progressive game incorporates a number of gaming tables such as baccarat tables 123A and 123B, roulette tables 124A and 124B, crap tables 125A and 125B, and slot machine bank 121. When a winning combination is reached at any of the tables involved in the progressive game, the dealer for the game presses a button on his key pad associated with the player's station number having a winning combination and the information is received in a central recording station 130, which may be a conventional PC computer. The recording station 130 also records the reception of a token in the first or second slots for the play stations at each of the gaming tables 123A, 123B, 124A, 124B, 125A, 125B, and 121 and when a winning combination is determined to have occurred the recording center 130 will direct a portion of the jackpot to the appropriate players participating in the progressive game. The existence of a winning combination will also be projected on a reader board 132 visible to all plays in the casino to notify the winner that his winning combination is acknowledged, and to attract attention to the game.

The game can incorporate a proxy progressive jackpot or a universal proxy progressive jackpot whereby any player can deposit tokens into the second slot 38, 61, 94, 112 associated with his play station. In one embodiment, the proxy progressive game requires that the player deposit one token for each of the six positions on a play surface such that playing the proxy progressive game entitles a player to win whenever there is a winner to the primary progressive game. In a second embodiment of the proxy progressive game, the key pad 37, 51, 93, 111 keyboard is provided to enable each player to select the numbers for one or more of the play stations, other than his own, and participate in the award for the proxy progressive game in the event the winning combination occurs for a number he has selected.

While several embodiments of the present invention have been disclosed, it will be appreciated that many variations and modifications can be made without departing from the true spirit and scope of the present invention. Therefore, it is intended by the following claims to cover all such modifications and variations which come within the true spirit and scope of the invention.

What is claimed:

1. The method of providing a wagering for an additional reward to players of a casino comprising the steps of providing a plurality of gaming tables where each of said gaming tables has a play surface for use in one of the games played at said casino, each said play surface having play stations thereon for use by one of said players, all of said tables having the same given total number of play stations;

a set of identification numbers where the total number of distinct identification numbers in said set is equal to said given total number, one of said set of identification numbers for each play station of a table with no two play stations at a single table having the same identification number whereby all the identification numbers of said set are employed at each of said tables, a supplemental wagering receptor at each of said play stations for receiving a wagering token for wagering for said additional reward;

for each of one of said games selecting a set of conditions for winning said additional reward where said set of conditions includes the occurrence in said one of said games of a number equal to the identification number of one of said play stations, providing a central recording means for recording the occurrence of said selected set of conditions at one of said gaming tables, recording said occurrence of said selected set of conditions for winning by a first player at a first play station having a given identification number, and paying a portion of said additional reward to a second player at a second play station for which a token has been deposited in said receptor and said second play station has an identification marking identical to said first given identification number.

2. The method of claim 1 and further comprising the steps of providing a first plurality of play surfaces of said tables for use with a first game, providing a second plurality of play surfaces of said tables for use with a second game which is different from said first game, selecting a first set of conditions for winning by a player of said first game to win said additional reward, selecting a second set of conditions for winning by a player of said second game to win said additional reward, and said first set of conditions being different from said second set of conditions.

3. The method of claim 1 wherein one of said play surfaces is for playing the game of roulette and includes a roulette wheel having an outer race with numbered areas thereon where the numbers of said areas of said race are equal to the number of said play stations, and said conditions for winning occurring for a player at one of said numbered play stations when said player bets on a number associated with the number of said numbered play stations, a roulette ball lands in a hole for said number and the roulette wheel comes to rest adjacent to one of said areas bearing a number equal to said number of said one of said numbered play station.

4. The method of claim 1 wherein one of said play surfaces is for playing the game of blackjack, and said conditions for winning occurring for a player at one of said numbered play station for said game of blackjack when said dealer's hand and said player's hand both have pairs and the numbers on all four cards are equal to the number of said one of said numbered play stations.

5. The method of claim 1 wherein one of said play surfaces is for playing the game of poker, and said conditions for winning occur for a player at one of said numbered play stations for said game of poker when the dealer's hand has four of a kind and all four cards have numbers equal to the numbers of said one of said numbered play stations.

6. The method of claim 1 wherein one of said play surfaces is for playing the game of roulette and includes a roulette wheel having an outer race with numbered areas thereon where the numbers of said areas of said race are equal to the number of said play stations, and said conditions for winning occurring for a player at a first of said numbered play stations when a roulette ball lands in a hole for a number play stations when said player bets on a number associated with the number of said first of said numbered play stations, a roulette ball lands in a hole for said number and the roulette wheel comes to rest adjacent to one of said areas bearing a number equal to said number of said first of said numbered play station, a second of said play surfaces is for playing the game of blackjack, and said conditions for winning occurring for a player at a second of said numbered play station for said game of blackjack when said dealer's hand and said player's hand both have pairs and the numbers on all four cards are equal to the number of said second of said numbered play stations, and a third of said play surfaces is for playing the game of poker, and said conditions for a winning occur for a player at a third of said numbered play stations for said game of poker when the dealer's hand has four of a kind and all four cards have numbers equal to the numbers of said third of said numbered play stations.

7. The method of providing a wagering for an additional reward to players of a casino comprising the steps of providing a plurality of gaming tables, providing a progressive game wherein said players may win a reward separate from a reward for the winning of the game played at said table, each of said gaming tables having (a) a play surface for use in one of the games played at said casino, (b) a given number of play stations for use by said players, (c) a set of identification numbers equal to said given number, one for each of said play stations wherein no two stations at the same table bear the same identification number whereby all the identification numbers of said set are employed at each of said tables, (d) a first receptor at each said play station for receiving a wagering token for wagering for said progressive game, (e) a second receptor at each said play station for receiving a wagering token for said additional reward, (f) each of said play stations having means for selecting an identification number of a play station where said selected identification number is different from the number of the play station from which the selection is made, all of said tables having the same given number of play stations or a multiple of said given number of play stations, for each said game, selecting a set of conditions for winning said additional reward where said set of conditions includes the occurrence in said games of a number equal to the identification number of one of said play stations, providing a central recording means for recording the occurrence of said selected set of conditions at one of said gaming tables, recording said occurrence of said selected set of conditions for winning by a first player at a first play station having a given identification number, and paying a portion of said reward to a second player at a second play station for which a token has been deposited in said second receptor and said given identification number has been selected on said means for selecting.

8. The method of claim 7 and further comprising the steps of providing a first plurality of play surfaces of said tables for use with a first game, providing a second plurality of play surfaces of said tables for use with a second game which is different from said play surfaces of said first game, selecting a first set of conditions for a player of said first game to win said additional reward, and selecting a second set of conditions for a player of said second game to win said additional reward.

9. The method of claim 7 wherein one of said play surfaces is for playing the game of roulette and includes a roulette wheel having an outer race with numbered areas thereon where the numbers of said areas of said race are equal to the number of said play stations, and said conditions for winning occurring for a player at one of said numbered play stations when said player bets on a number associated with the number of said numbered play stations, a roulette ball lands in a hole for said number and the roulette wheel comes to rest adjacent to one of said areas bearing a number equal to said number of said one of said numbered play station.

10. The method of claim 7 wherein one of said play surfaces is for playing the game of blackjack, and said conditions for winning occurring for a player at one of said numbered play station for said game of blackjack when said dealer's hand and said player's hand both have pairs and the numbers on all four cards are equal to the number of said one of said numbered play stations.

11. The method of claim 7 wherein one of said play surfaces is for playing the game of poker, and said conditions for winning occur for a player at one of said numbered play stations for said game of poker when the dealer's hand has four of a kind and all four cards have numbers equal to the numbers of said one of said numbered play stations.

12. The method of claim 7 wherein one of said play surfaces is for playing the game of roulette and includes a roulette wheel having an outer race with numbered areas thereon where the numbers of said areas of said race are equal to the number of said play stations, and said conditions for winning occurring for a player at a first of said numbered play stations when a roulette ball lands in a hole for a number play stations when said player bets on a number associated with the number of said first of said numbered play stations, a roulette ball lands in a hole for said number and the roulette wheel comes to rest adjacent to one of said areas bearing a number equal to said number of said first of said numbered play station, a second of said play surfaces is for playing the game of blackjack, and said conditions for winning occurring for a player at a second of said numbered play station for said game of blackjack when said dealer's hand and said player's hand both have pairs and the numbers on all four cards are equal to the number of said second of said numbered play stations, and a third of said play surfaces is for playing the game of poker, and said conditions for winning occur for a player at a third of said numbered play stations for said game of poker when the dealer's hand has four of a kind and all four cards have numbers equal to the numbers of said third of said numbered play stations.

13. The method of providing a wagering for an additional reward to players of a casino comprising the steps of providing a progressive game wherein said players may win a reward separate from a reward for the winning of the game played at said table, each of said gaming tables having (a) a play surface for use in one of the games played at said casino, (b) a given number of play stations for use by said players, (c) a set of identification symbols equal in number to said given number, one for each said play station wherein no two stations at the same table bear the same identification symbol whereby all the identification symbols of said set are employed at each of said tables, (d) a receptor at each said play station for receiving a wagering token for wagering for said progressive game, (e) each of said play stations having means for selecting an identification symbol of a play station where said selected identification symbol is different from the symbol of the play station from which the selection is made, for each of said game, selecting a set of conditions for winning said additional reward where said set of conditions includes the occurrence in said games of a symbol equal to the identification symbol of one of said play stations, providing a central recording means for recording the occurrence of said selected set of conditions at one of said gaming tables, recording said occurrence of said selected set of conditions for winning by a first player at a first play station having a given identification symbol, and paying a portion of said reward to a second player at a second play station for which a token has been deposited in said receptor and said given identification symbol has been selected on said means for selecting.

14. The method of providing an additional reward to players of a casino comprising the steps of providing a plurality of gaming tables where said gaming tables have (a) a play surface for use in one of the games played at said casino, (b) each said play surface having a given number of play stations thereon for use by one of said players, (c) all of said tables having the same given number of play stations, (d) a set of identification symbols equal to said given number, one for each play station of each table whereby all of said identification numbers of said set are employed at each of said tables, for each of said game, selecting a set of conditions for winning said additional reward where said set of conditions includes the occurrence in said game of a number equal to the identification symbol of one of said play stations, recognizing the occurrence of said selected set of conditions for winning by a first player at a first play station having a given identification symbol, and paying a portion of said additional reward to a second player at a second play station for which said second play station has an identification symbol identical to said first given identification symbol.

15. The method of providing a wagering for an additional reward to players of a casino comprising the steps of providing a plurality of gaming tables where each of said gaming tables has a play surface for use in one of the games played at said casino, each said play surface having play stations thereon for use by one of said players, all of said tables having the same given total number of play stations, or a multiple of said given number of play stations;

a set of identification numbers where the total number of distinct identification numbers in said set is equal to said given total number, one of said set of identification numbers for each play station of a table with no two play stations at a single table having the same identification number whereby all the identification numbers of said set are employed at each of said tables, a supplemental wagering receptor at each of said play stations for receiving a wagering token for wagering for said additional reward;

for each of one of said games selecting a set of conditions for winning said additional reward where said set of conditions includes the occurrence in said one of said game of a number equal to the identification number of one of said play stations, providing a central recording means for recording the occurrence of said selected set of conditions at one of said gaming tables, recording said occurrence of said selected set of conditions for winning by a player at a first play station having a given identification number, and paying a portion of said additional reward to a said player provided a token has been deposited in said receptor for said first play station.

16. The method of providing a wagering for an additional reward to players of a casino comprising the steps of providing a progressive game wherein said players may win a reward separate from a reward for the winning of the game played at said table, each of said gaming tables having (a) a play surface for use in one of the games played at said casino, (b) all of said play surfaces having the same given number of play stations for use by said player, (c) a set of identification symbols equal in number to said given number, one for each said play station wherein no two stations at the same table bear the same identification symbol and whereby all the identification symbols of said set are employed at each of said tables, (d) a receptor at each said play station for receiving a wagering token for wagering for said progressive game, (e) each of said play stations having means for selecting an identification symbol of a play station where said selected identification symbol is different from the symbol of the play station from which the selection is made, for each of said game, selecting a set of conditions for winning said additional reward where said set of conditions includes the occurrence in said games of a symbol equal to the identification symbol of one of said play stations, providing a central recording means for recording the occurrence of said selected set of conditions at one of said gaming tables, recording said occurrence of said selected set of conditions for winning by a player at a first play station having a given identification symbol, and paying a portion of said reward to a player at said first play station provided a token has been deposited in said receptor for said first play station.

* * * * *

UNITED STATES PATENT AND TRADEMARK OFFICE

CERTIFICATE OF CORRECTION

PATENT NO. : 6,299,533 B1 
DATED : October 9, 2001
INVENTOR(S) : Anthony C. Parra and Debra L. Parra It is certified that error appears in the above-identified patent and that said Letters Patent is hereby corrected as shown below:

Column 5,
Line 36, after "pad" delete "usably" and substitute -- usable --.

Column 7,
Line 42, after "each" delete "of".

Column 8,
Line 42, delete the entire line stating "when a roulette ball lands in a hole for a number play".
Line 43, beginning of the line delete "stations".

Column 10,
Line 43, beginning of the line, delete "numbers" and substitute -- number --.

Signed and Sealed this

Fifteenth Day of October, 2002

*Attest:*

*Attesting Officer*

JAMES E. ROGAN
*Director of the United States Patent and Trademark Office*